US008131186B2

(12) United States Patent
Hatakeyama et al.

(10) Patent No.: US 8,131,186 B2
(45) Date of Patent: Mar. 6, 2012

(54) DEVELOPING DEVICE

(75) Inventors: Takashi Hatakeyama, Kanagawa (JP); Minoru Yoshida, Tokyo (JP); Takao Izumi, Kanagawa (JP); Hiroshi Murata, Kanagawa (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 630 days.

(21) Appl. No.: 12/327,918

(22) Filed: Dec. 4, 2008

(65) Prior Publication Data

US 2009/0148193 A1 Jun. 11, 2009

Related U.S. Application Data

(60) Provisional application No. 60/992,939, filed on Dec. 6, 2007.

(51) Int. Cl.
*G03G 15/08* (2006.01)

(52) U.S. Cl. ..... 399/257; 399/44; 399/254

(58) Field of Classification Search ..... 399/254, 399/256, 257, 258, 259, 44
See application file for complete search history.

(56) References Cited

U.S. PATENT DOCUMENTS

| | | | | |
|---|---|---|---|---|
| 6,587,661 | B1 * | 7/2003 | Shimmura et al. | 399/257 |
| 7,356,288 | B2 * | 4/2008 | Iwata et al. | 399/254 |
| 7,831,181 | B2 * | 11/2010 | Hatakeyama et al. | 399/254 X |
| 7,856,196 | B2 * | 12/2010 | Sakamoto et al. | 399/254 |
| 2007/0231015 | A1 * | 10/2007 | Sakamaki | 399/257 |
| 2008/0152394 | A1 * | 6/2008 | Hatakeyama et al. | 399/256 |

FOREIGN PATENT DOCUMENTS

| | | |
|---|---|---|
| JP | 59-100471 | 6/1984 |
| JP | 2003-015418 | 1/2003 |

* cited by examiner

*Primary Examiner* — Sophia S Chen
(74) *Attorney, Agent, or Firm* — Turocy & Watson, LLP

(57) ABSTRACT

In an embodiment, a contact pivoting plate, which comes into contact with a developer swelled by a discharge mixer, is provided in a case. The contact pivoting plate is pivoted according to a detection result of a temperature and humidity sensor to change the magnitude of resistance by the contact pivoting plate with respect to a flow of the developer. The height of the swell of the developer is suppressed from fluctuating according to an environmental change. The fluctuation in an amount of an excess developer discharged from a discharge port is suppressed to replace a deteriorated carrier in a development container with a new carrier little by little.

24 Claims, 13 Drawing Sheets

FIG. 7

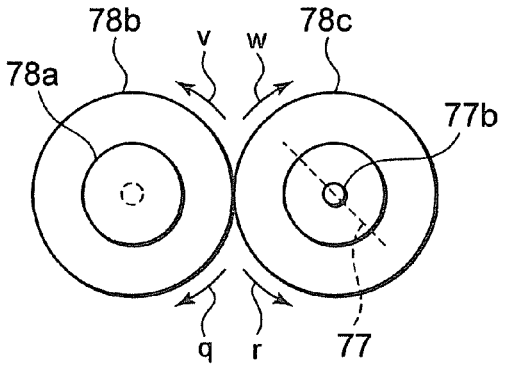

FIG. 8

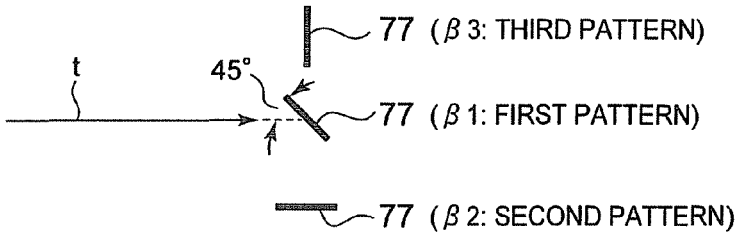

FIG. 9

ENVIRONMENT LIFE TEST RESULTS OF 10000 SHEETS

| | TEMPERATURE/ HUMIDITY | 20°C/50% | 30°C/80% | 10°C/20% | 30°C/80% |
|---|---|---|---|---|---|
| | | 2500 SHEETS | 5000 SHEETS | 7500 SHEETS | 10000 SHEETS |
| UNEVENNESS OF TONER DENSITY (REDUCTION OF TONER DENSITY) | FIRST EMBODIMENT | ○ | ○ | ○ | ○ |
| | COMPARATIVE EXAMPLE 1 | ○ | △(UNEVENNESS OF TONER DENSITY) | △ (REDUCTION OF TONER DENSITY) | △(UNEVENNESS OF TONER DENSITY) |
| SPILL OF DEVELOPER | FIRST EMBODIMENT | ○ | ○ | ○ | ○ |
| | COMPARATIVE EXAMPLE 1 | ○ | ○ | ○ | ○ |

TABLE 1

FIG. 17

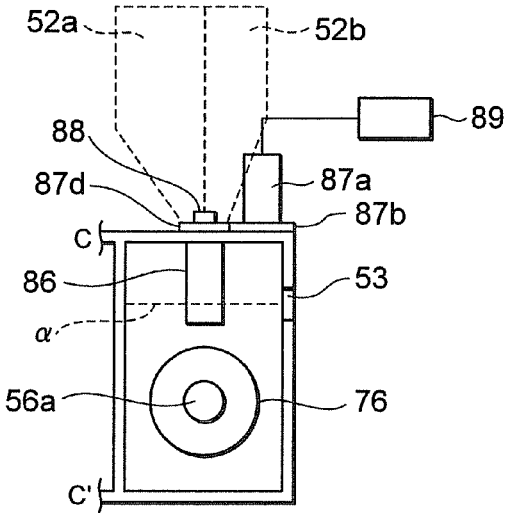

FIG. 18

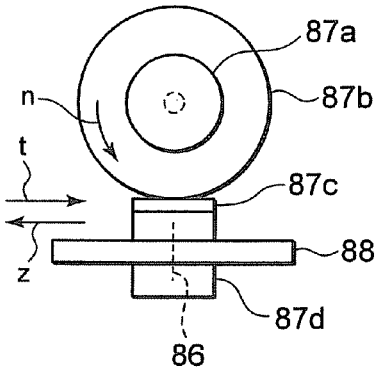

FIG. 19

ENVIRONMENT LIFE TEST RESULTS OF 10000 SHEETS

| | TEMPERATURE/ HUMIDITY | 20°C/50% | 30°C/80% | 10°C/20% | 30°C/80% |
|---|---|---|---|---|---|
| | | 2500 SHEETS | 5000 SHEETS | 7500 SHEETS | 10000 SHEETS |
| UNEVENNESS OF TONER DENSITY (REDUCTION OF TONER DENSITY) | FIRST EMBODIMENT | ○ | ○ | ○ | ○ |
| | SECOND EMBODIMENT | ○ | ○ | ○ | ○ |
| | THIRD EMBODIMENT | ○ | ○ | ○ | ○ |
| | COMPARATIVE EXAMPLE 2 | ○ | × (UNEVENNESS OF TONER DENSITY) | × (REDUCTION OF TONER DENSITY) | × (UNEVENNESS OF TONER DENSITY) |
| SPILL OF DEVELOPER | FIRST EMBODIMENT | ○ | ○ | ○ | ○ |
| | SECOND EMBODIMENT | ○ | ○ | ○ | ○ |
| | THIRD EMBODIMENT | ○ | ○ | ○ | ○ |
| | COMPARATIVE EXAMPLE 2 | ○ | × | ○ | × |

TABLE 2

DEVELOPING DEVICE

CROSS-REFERENCE TO RELATED APPLICATIONS

This application is based upon and claims the benefit of priority from provisional U.S. Application 60/992,939 filed on Dec. 6, 2007, the entire contents of which are incorporated herein by reference.

TECHNICAL FIELD

The present invention relates to a developing device that performs development using a two-component developer including a toner and a carrier in an image forming apparatus of an electrophotographic system such as a copying machine or a printer.

BACKGROUND

As a developing device used in an image forming apparatus such as a copying machine or a printer, there is a device that performs development using a two-component developer. In the developing device that uses the two-component developer, a toner equivalent to an amount consumed by a development operation is supplied. However, in such a developing device, performance of a carrier falls to cause deterioration in charging performance of the toner while the toner is supplied.

A system called trickle development system is provided in order to suppress the deterioration in the charging performance of the toner. The trickle development system is a system for supplying a new carrier (a concentrated toner) to a development container separately from the toner supplied to supplement the consumed amount. An excess developer that cannot be stored in the development container because of the supply of the carrier is discharged from a discharge port. In this way, the deteriorated carrier is replaced with the new carrier little by little.

As such a developing device of the trickle system, for example, JP-B-2-21591 discloses a device that supplies a carrier and a toner to a development container according to development operation and discharges an excess developer from the development container.

On the other hand, in the developing device of the trickle system, the quantity of the developer in the development container changes according to an environmental condition to change the height of the surface of the developer. Therefore, in the developing device, an amount of the excess developer discharged from the discharge port changes according to an environmental change. As a result, an amount of the developer in the development container is not stabilized and, therefore, it is likely that development performance is significantly affected.

Therefore, for example, JP-A-2003-15418 discloses a device that changes the height of a lower surface of a discharge port for an excess developer according to an environmental condition and stabilizes an amount of discharge of the excess developer.

Such a device moves a shutter provided in the discharge port up and down to change the height of the lower surface of the discharge port. This makes it difficult to seal a gap between the discharge port and the shutter to prevent the developer from leaking. It is likely that the developer leaks from the gap between the discharge port and the shutter and soils a section around the discharge port and the shutter. It is also likely that the movement of the shutter is deteriorated by the developer adhering thereto.

Therefore, it is desirable to stabilize an amount of discharge of an excess developer even if an environmental condition changes and, in stabilizing the amount of discharge, prevent the developer from leaking. As a result, there is a demand for the development of a developing device that can suppress a developer amount in a development container from fluctuating, satisfactorily maintain development performance, and maintain a high image quality.

SUMMARY

According to an aspect of the present invention, even if the environment changes, an amount of discharge of a developer discharged from a discharge port is substantially constant. A developer amount in a developer container is suppressed from fluctuating to stabilize the amount of the developer and improve a quality of a toner image through a satisfactory development characteristic.

According to an embodiment of the present invention, there is provided a developing device including: a development container that stores a developer including a toner and a carrier and discharges a part of the developer from a discharging member; a developing member that feeds the developer in the development container to an image bearing member; a developer supplying member that supplies the developer to the development container; an agitating and carrying member that agitates the developer and circulates and carries the developer in the development container; a swelling member that swells the surface of the developer, which is opposed to the discharging member; and an adjusting member that adjusts the height of the developer, which is swelled by the swelling member, according to a detection result of an environment detecting member.

DESCRIPTION OF THE DRAWINGS

FIG. 7 is a schematic diagram for explaining the driving unit for the contact pivoting plate viewed from an upper surface according to the first embodiment;

FIG. 8 is a schematic diagram for explaining patterns of the contact pivoting plate to be set according to an environmental change according to the first embodiment;

FIG. 9 is Table 1 of results of environmental life tests according to the first embodiment and a comparative example 1;

FIG. 17 is a schematic diagram for explaining a driving unit for the contact slide plate viewed from a C-C' side in FIG. 16 according to the third embodiment;

FIG. 18 is a schematic diagram for explaining the driving unit for the contact slide plate viewed from an upper surface according to the third embodiment;

FIG. 19 is Table 2 of results of environmental life tests according to the first to third embodiments and a comparative example 2;

DETAILED DESCRIPTION

Figure 1:
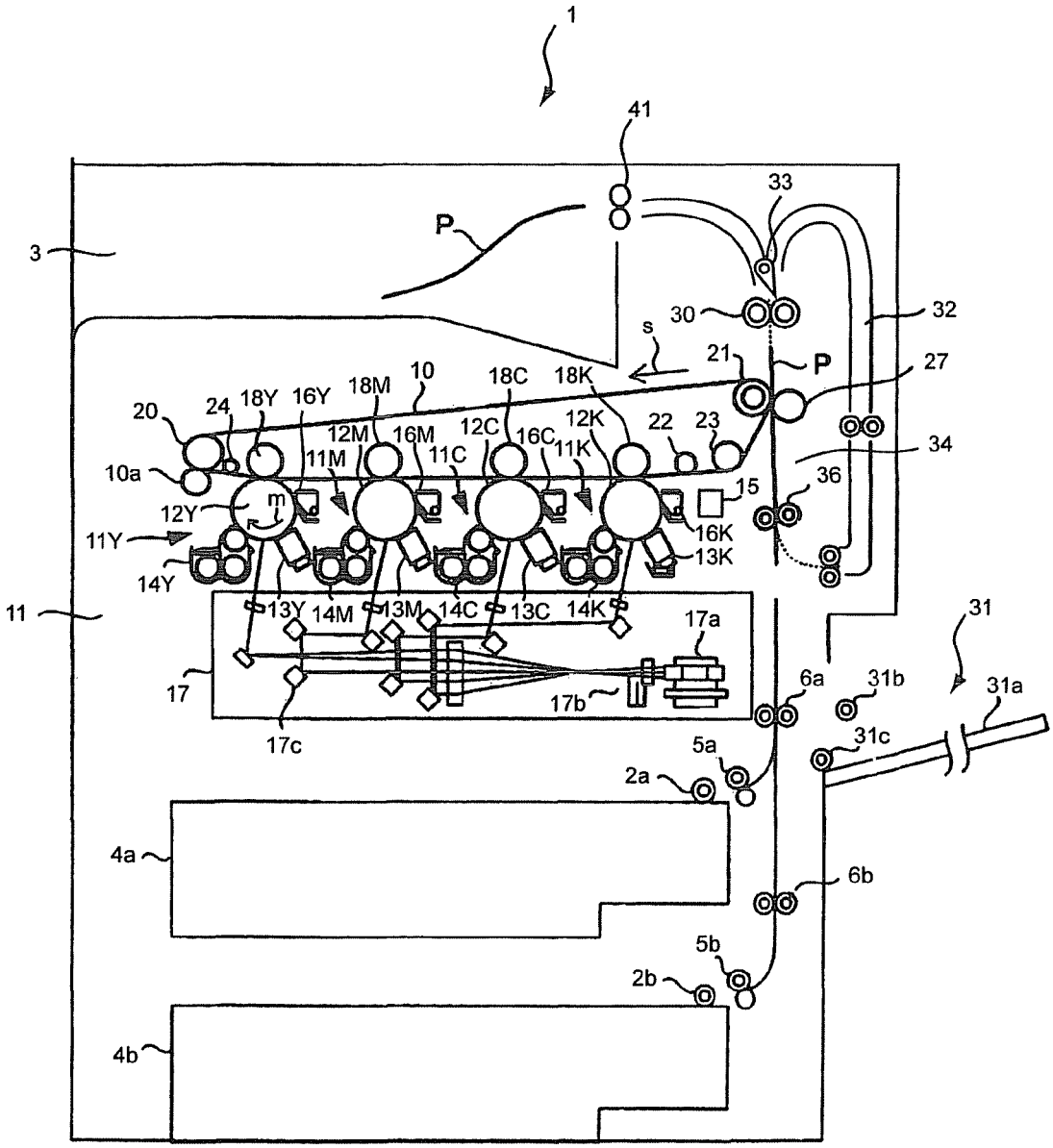
FIG. 1 is an overall structural diagram of an image forming apparatus according to a first embodiment of the present invention.

A first embodiment of the present invention is explained below with reference to the accompanying drawings. FIG. 1 is a schematic diagram of a color printer 1 according to the first embodiment. The color printer 1 is a quadruple tandem color printer. The color printer 1 includes a paper discharging unit 3 in an upper part thereof.

The color printer 1 includes an image forming unit 11 on a lower side of an intermediate transfer belt 10. The image forming unit 11 includes four sets of process units 11Y, 11M, 11C, and 11K arranged in parallel along the intermediate transfer belt 10. The process units 11Y, 11M, 11C, and 11K form toner images of yellow (Y), magenta (M), cyan (C), and black (K), respectively.

Figure 2:
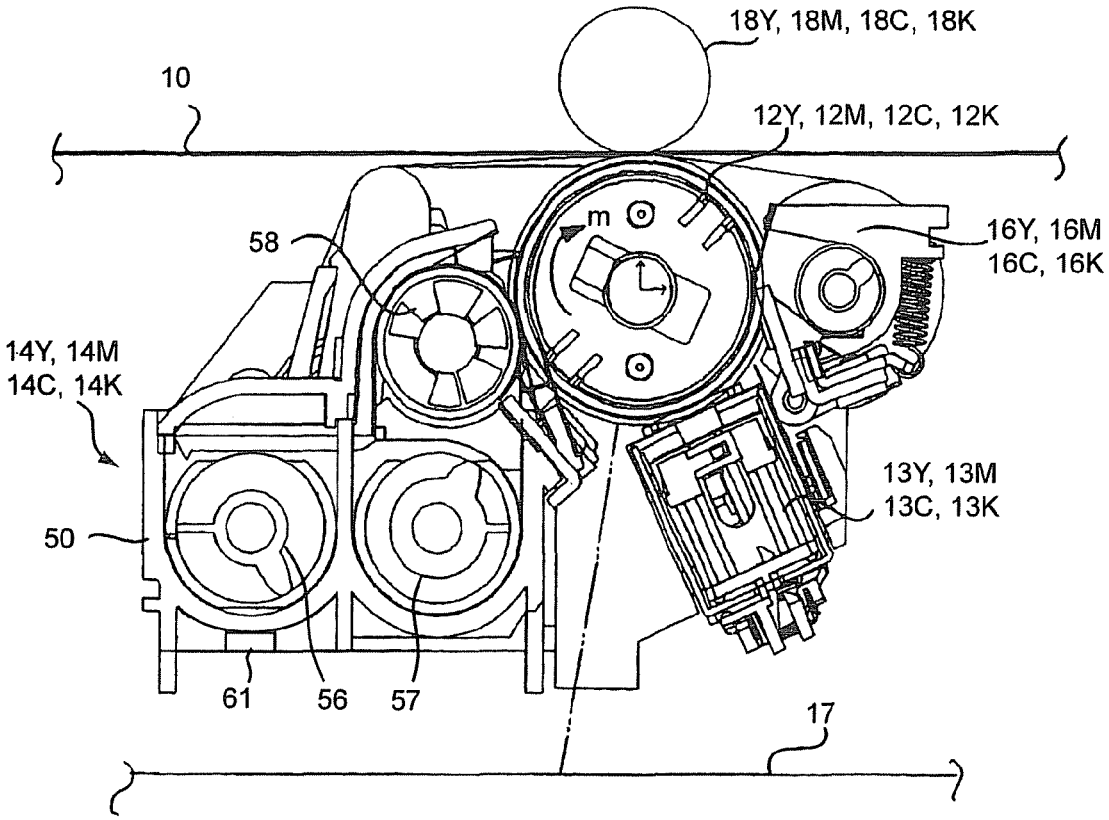
FIG. 2 is a schematic diagram for explaining an image forming unit according to the first embodiment.

As shown in FIG. 2, the process units 11Y, 11M, 11C, and 11K respectively include photoconductive drums 12Y, 12M, 12C, and 12K as image bearing members. The photoconductive drums 12Y, 12M, 12C, and 12K rotate in an arrow "m" direction. Electrification chargers 13Y, 13M, 13C, and 13K, developing devices 14Y, 14M, 14C, and 14K, and photoconductive cleaners 16Y, 16M, 16C, and 16K are arranged around the photoconductive drums 12Y, 12M, 12C, and 12K, respectively, along the rotating direction of the photoconductive drums 12Y, 12M, 12C, and 12K.

Exposure lights emitted by a laser exposing device 17 are respectively irradiated on sections between the electrification chargers 13Y, 13M, 13C, and 13K and the developing devices 14Y, 14M, 14C, and 14K around the photoconductive drums 12Y, 12M, 12C, and 12K. The laser exposing device 17 scans laser beams emitted from semiconductor laser elements in the axial directions of the photoconductive drums 12. The laser exposing device 17 includes a polygon mirror 17*a*, a focusing lens system 17*b*, and a mirror 17*c*. Electrostatic latent images are formed on the photoconductive drums 12Y, 12M, 12C, and 12K by the laser exposing device 17. The electrification chargers 13Y, 13M, 13C, and 13K and the laser exposing device 17 configure a latent image forming member. A temperature and humidity sensor 15 as an environment detecting member is provided near the image forming unit 11 of the color printer 1.

The developing devices 14Y, 14M, 14C, and 14K develop the electrostatic latent images on the photoconductive drums 12Y, 12M, 12C, and 12K, respectively. Each developing device 14Y, 14M, 14C, or 14K performs development using two-component developer. Each two-component developer includes yellow (Y) toner and carrier, magenta (M) toner and carrier, cyan (C) toner and carrier, or black (K) toner and carrier.

The intermediate transfer belt 10 is stretched and suspended by a backup roller 21, a driven roller 20, and first to third tension rollers 22 to 24 and rotates in an arrow "s" direction.

The intermediate transfer belt 10 is opposed to and set in contact with the photoconductive drums 12Y, 12M, 12C, and 12K. Primary transfer rollers 18Y, 18M, 18C, and 18K are respectively provided in positions of the intermediate transfer belt 10 opposed to the photoconductive drums 12Y, 12M, 12C, and 12K. The primary transfer rollers 18Y, 18M, 18C, and 18K primarily transfer toner images formed on the photoconductive drums 12Y, 12M, 12C, and 12K onto the intermediate transfer belt 10, respectively. The photoconductive cleaners 16Y, 16M, 16C, and 16K remove and collect residual toners on the photoconductive drums 12Y, 12M, 12C, and 12K, respectively, after the primary transfer.

A secondary transfer roller 27 is opposed to a secondary transfer section of the intermediate transfer belt 10 supported by the backup roller 21. In the secondary transfer section, predetermined secondary transfer bias is applied to the backup roller 21. When a sheet paper P passes between the intermediate transfer belt 10 and the secondary transfer roller 27, the toner images on the intermediate transfer belt 10 are secondarily transferred onto the sheet paper P. The sheet paper P is fed from paper feeding cassettes 4*a* and 4*b* or a manual feed mechanism 31. After the secondary transfer is finished, the intermediate transfer belt 10 is cleaned by a belt cleaner 10*a*.

Pickup rollers 2*a* and 2*b*, separation rollers 5*a* and 5*b*, conveying rollers 6*a* and 6*b*, and a registration roller pair 36 are provided between the paper feeding cassettes 4*a* and 4*b* and the secondary transfer roller 27. A manual feed pickup roller 31*b* and a manual feed separation roller 31*c* are provided between a manual feed tray 31*a* of the manual feed mechanism 31 and the registration roller pair 36. A fixing device 30 is provided further downstream than the secondary transfer section along the direction of a vertical conveying path 34. The fixing device 30 fixes the toner images, which are transferred on the sheet paper P in the secondary transfer section, on the sheet paper P. A gate 33 that distributes the sheet paper P in the direction of a paper discharge roller 41 or the direction of a re-conveying unit 32 is provided downstream of the fixing device 30. The sheet paper P guided to the paper discharge roller 41 is discharged to a paper discharging unit 3. The sheet paper P guided to the re-conveying unit 32 is guided in the direction of the secondary transfer roller 27 again.

The developing devices 14Y, 14M, 14C, and 14K are explained in detail below. The developing devices 14Y, 14M, 14C, and 14K have the same structure. Therefore, components of the developing devices 14Y, 14M, 14C, and 14K are explained by using the same reference numerals and signs. As shown in FIG. 2, each of the developing devices 14Y, 14M, 14C, and 14K includes a case 50 as a development container, a developing roller 58 as a developing member, a first mixer 56 and a second mixer 57 as agitating and carrying members, and a toner density sensor 61.

Figure 3:
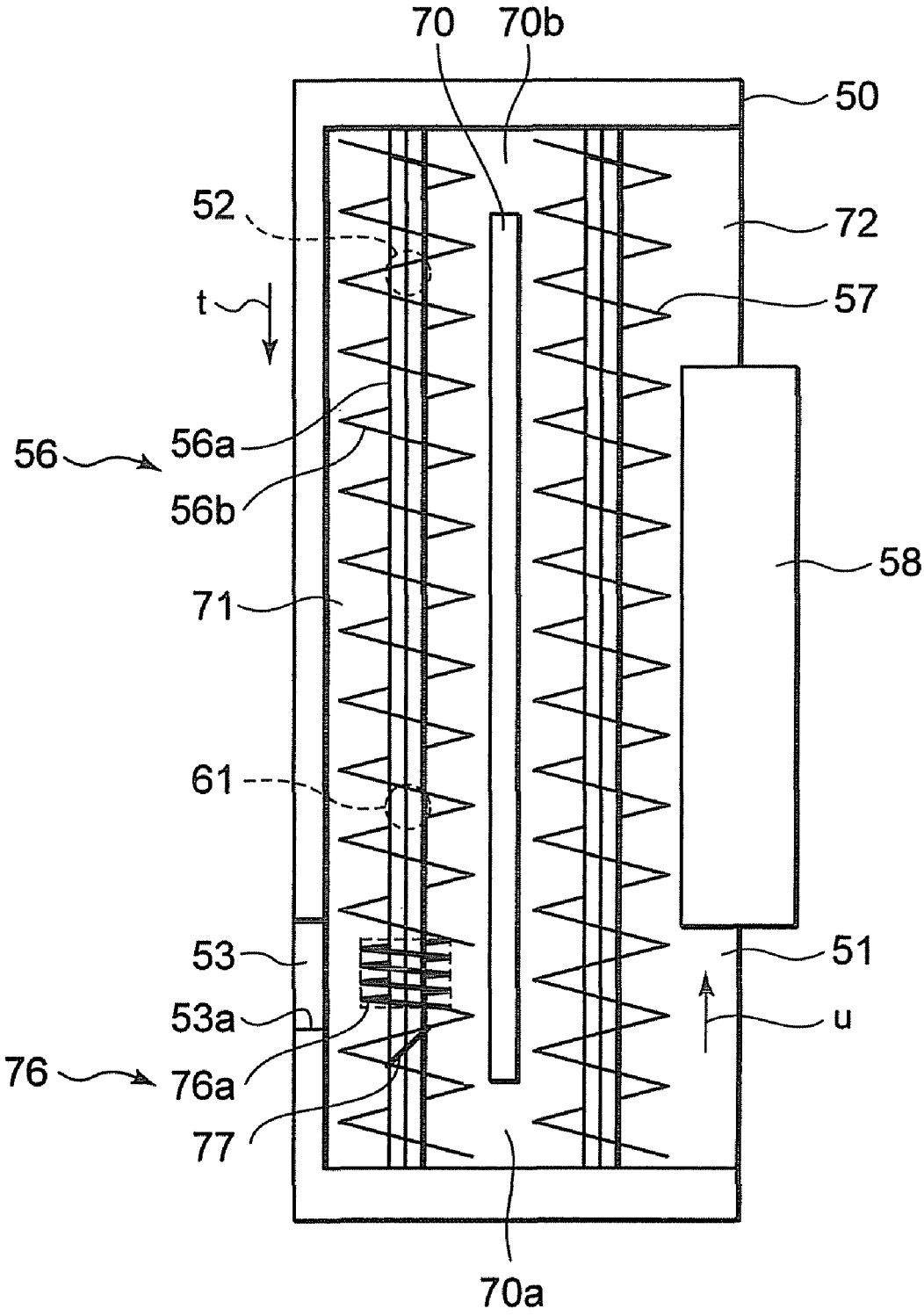
FIG. 3 is a schematic diagram for explaining a flow of a developer in a development container according to the first embodiment.
Figure 6:
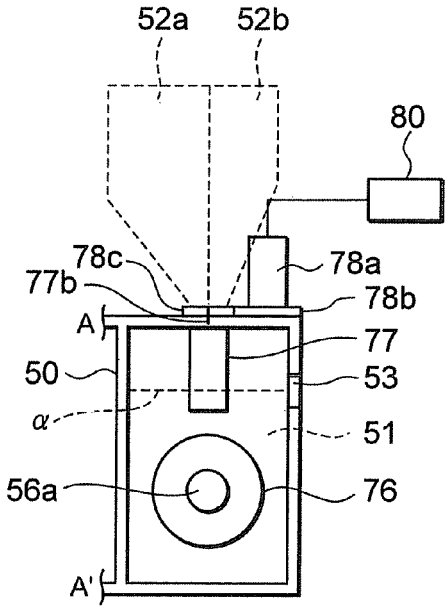
FIG. 6 is a schematic diagram for explaining a driving unit for a contact pivoting plate viewed from an A-A' side in FIG. 4 according to the first embodiment.

As shown in FIG. 3, a supply port 52 for a developer 51 is formed in the case 50 that stores the developer 51. For example, as shown in FIG. 6, a toner cartridge 52*a* that stores a toner for supply and a carrier cartridge 52*b* that stores a carrier for supply are attached to the supply port 52. In this embodiment, a developer supplying member indicates a combined unit of the toner cartridge 52*a* and the carrier cartridge 52*b*. A toner equivalent to an amount consumed by development is supplied to the supply port 52 from the toner cartridge 52*a*. A new carrier is also supplied to the supply port 52 from the carrier cartridge 52*b*. As the supply of the new carrier, only a carrier may be supplied. Alternatively, although not shown in the figure, a carrier may be supplied together with a toner by one cartridge that stores a two-component developer including the toner and the carrier. A deteriorated old carrier is replaced with the new carrier little by little by supplying a predetermined amount of the new carrier while development-operation is performed. Consequently, toner charging performance of the developer 51 in the case 50 is prevented from being deteriorated.

Figure 4:
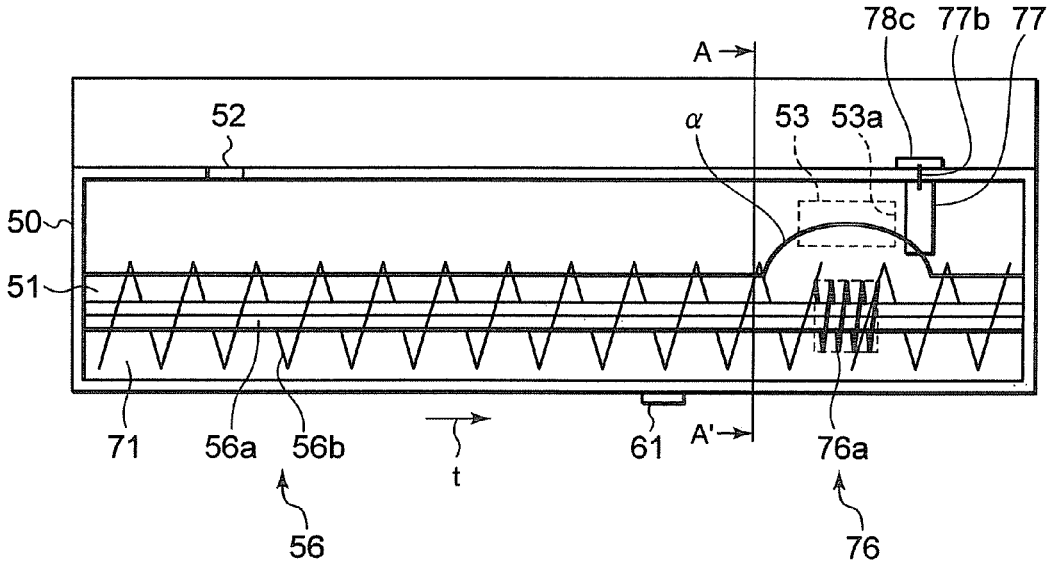
FIG. 4 is a schematic diagram for explaining the swell of the developer in the development container according to the first embodiment.

As shown in FIGS. 3 and 4, a discharge port 53 as a discharging member is formed in a side portion on a front side of the case 50. Since the volume of the developer 51 in the case 50 is increased by the supply of the new carrier, an excess developer is discharged from the discharge port 53 and collected. Consequently, in the case 50, an amount of the developer 51 is maintained constant. At the same time, in the case 50, the deteriorated old carrier is replaced with the new carrier little by little in the developer 51.

The developing roller 58 carries the developer 51 in the case 50 to a development position and feeds toners to electrostatic latent images formed on the photoconductive drums 12Y, 12M, 12C, and 12K, respectively. The inside of the case 50 is partitioned by a partition plate 70 along the axial direction of the photoconductive drums 12Y, 12M, 12C, and 12K. The inside of the case 50 is partitioned into a first agitation passage 71 and a second agitation passage 72 by the partition plate 70. In the first agitation passage 71, the new toner and the new carrier supplied from the developer supply port 52 and the developer 51 in the case 50 are agitated and carried in an arrow "t" direction by the first mixer 56. The developer 51 agitated and carried by the first mixer 56 is carried to the second agitation passage 72 through a first conducting section 70*a*. In the second agitation passage 72, the developer 51 is agitated and carried in an arrow "u" direction by the second mixer 57 and supplied to the developing roller 58. The developer 51 passing through the developing roller 58 is carried to the first agitation passage 71 through a second conducting section 70*b*. The developer 51 is circulated and carried in the case 50 by the first mixer 56 and the second mixer 57.

The toner density sensor 61 is provided on a bottom surface downstream of the developer supply port 52 in the first agitation passage 71 in the arrow "t" direction. As the toner density sensor 61, for example, a magnetic permeability sensor is used. When a reduction of toner density of the developer 51 in the case 50 is detected by the toner density sensor 61, the toner is supplied from the toner cartridge 52*a*. In this way, the toner density of the developer 51 in the case 50 is maintained constant.

In the position of the discharge port 53, a discharge mixer 76 as a swelling member is provided in the first mixer 56. As shown in FIGS. 3 and 4, the discharge mixer 76 is attached to a shaft 56*a* of the first mixer 56. Vanes 76*a* as swelling vanes member of the discharge mixer 76 have a diameter smaller than that of vanes 56*b* as agitating and carrying vanes of the first mixer 56. The vanes 76*a* of the discharge mixer 76 have a pitch narrower than a pitch of the vanes 56*b* of the first mixer 56. The discharge mixer 76 reduces the velocity of flow of the developer 51 circulated and carried in the case 50. If the velocity of flow of the developer 51 is reduced while the developer 51 is carried in the arrow "t" direction by the first mixer 56, the developer 51 is held up. As indicated by a solid line $\alpha$ in FIG. 4, the surface of the developer 51 is swelled high in a heap in a position opposed to the discharge port 53. The height of the heap shape of the developer 51 changes when an environmental condition changes.

In general, when the environment of a developing device has low humidity, a toner is easily charged in a development container. The volume of the developer increases when a charge amount of the toner is large. On the other hand, when the environment of the developing device has high humidity, the charge amount of the toner in the development container is reduced. The volume of the developer decreases when the charge amount of the toner is small.

Figure 5:
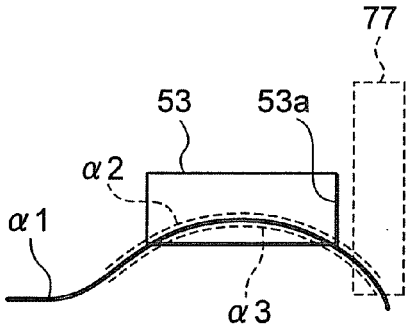
FIG. 5 is a schematic diagram for explaining a change in the swell of the developer due to an environmental change according to the first embodiment.

Therefore, when the environment has low humidity, the volume of the developer 51 in the case 50 increases and the height of the heap of the developer 51 swelled by the discharge mixer 76 increases. When the environment has high humidity, the volume of the developer 51 in the case 50 decreases and the height of the heap of the developer 51 swelled by the discharge mixer 76 decreases. For example, as shown in FIG. 5, the height of the heap of the developer 51 swelled by the discharge mixer 76 at the time when an environmental condition is "ordinary temperature and ordinary humidity" at the temperature of 20° C. and the humidity of 50% is as indicated by a solid line $\alpha$1. On the other hand, as relative humidity falls, the height of the heap of the developer 51 increases as indicated by a dotted line $\alpha$2. As the relative humidity rises, the height of the heap of the developer 51 decreases as indicated by a dotted line $\alpha$3.

In order to suppress such fluctuation in the height of the heap of the developer 51 due to the environmental change, a contact pivoting plate 77 as an adjusting member is provided in the case 50. The contact pivoting plate 77 is formed of, for example, a thin plate made of ABS resin (copolymer synthetic resin of Acrylonitrile-Butadiene-Styrene). The contact pivoting plate 77 is arranged further downstream than a side end 53*a* on the downstream side of the discharge port 53 in the arrow "t" direction. This makes it unlikely that the discharge of an excess developer discharged from the discharge port 53 is prevented by the contact pivoting plate 77. The contact pivoting plate 77 acquires resistance against the flow of the developer 51 in the arrow "t" direction by coming into contact with the surface of the developer 51. A driving unit for the contact pivoting plate 77 is shown in FIGS. 6 and 7. A rotating shaft 77*b* of the contact pivoting plate 77 is attached to a second gear 78*c* coupled to a first gear 78*b* of a stepping motor 78*a*. The stepping motor 78*a* is driven by a motor control unit 80 according to a detection result of the temperature and humidity sensor 15. When the stepping motor 78*a* is driven, the contact pivoting plate 77 is pivoted.

Angles of the contact pivoting plate 77 with respect to the arrow "t" direction, which is a circulating and carrying direction of the developer 51, are shown in FIG. 8. When an environmental condition detected by the temperature and humidity sensor 15 is, for example, "ordinary temperature and ordinary humidity" at the temperature of 20° C. and the humidity of 50%, the contact pivoting plate 77 is set in a first pattern indicated by β1. The contact pivoting plate 77 is set at 45° with respect to the arrow "t" direction. When the environmental condition is "low temperature and low humidity" at the temperature of 10° C. and the humidity of 20%, the contact pivoting plate 77 is set in a second pattern indicated by β2. The contact pivoting plate 77 is set parallel to the arrow "t" direction. When the environmental condition is "high temperature and high humidity" at the temperature of 30° C. and the humidity of 80%, the contact pivoting plate 77 is set in a third pattern indicated by β3. The contact pivoting plate 77 is set perpendicular to the arrow "t" direction. Set values of the environmental condition are not limited to the above.

The contact pivoting plate 77 set in the first pattern has a little resistance against the flow of the developer 51. Consequently, during ordinary humidity, the height of the heap of the developer is adjusted as indicated by the solid line α1 shown in FIG. 5. The contact pivoting plate 77 set in the second pattern has almost no resistance against the flow of the developer 51. Consequently, even during low humidity, the height of the heap of the developer 51 is adjusted to maintain α1. The contact pivoting plate 77 set in the third pattern has large resistance with respect to the flow of the developer 51. Consequently, even during high humidity, the height of the heap of the developer 51 is adjusted to maintain α1.

Operations of the contact pivoting plate 77 are explained below. In the case 50, a supply toner and a predetermined amount of a new carrier are supplied from the developer supply port 52 while development operation is performed. According to the rotation of the first mixer 56 and the second mixer 57, the developer 51 circulates in the arrow "t" direction and the arrow "u" direction in the case 50 together with the supply toner and the new carrier. The velocity of the flow of the developer 51 is reduced in the position of the discharge mixer 76 in the first agitation passage 71. The developer 51 is swelled in the position opposed to the discharge port 53. When the height of the surface of the developer 51 reaches the discharge port 53, an excess developer is discharged from the discharge port 53. Consequently, the deteriorated carrier in the development container 50 is replaced with the new carrier little by little.

During the operation explained above, the temperature and humidity sensor 15 detects the environment. When an environmental condition is "ordinary humidity" judging from a detection result, the contact pivoting plate 77 is set in the first pattern indicated by β1 shown in FIGS. 7 and 8. Thereafter, when the temperature and humidity sensor 15 detects that the environmental condition is "low humidity", the stepping motor 78*a* is driven by a predetermined step in an arrow "q" direction in FIG. 7 to pivot the contact pivoting plate 77 45° in an arrow "r" direction. The contact pivoting plate 77 is set in the second pattern indicated by β2 shown in FIG. 8. On the other hand, in a state of the first pattern, when the temperature and humidity sensor 15 detects that the environmental condition is "high humidity", the stepping motor 78*a* is driven by the predetermined step in an arrow "v" direction in FIG. 7 to pivot the contact pivoting plate 77 45° in an arrow "w" direction. The contact pivoting plate 77 is set in the third pattern indicated by β3 shown in FIG. 8.

During ordinary humidity, the height of the heap of the developer 51 is maintained at α1 by the contact with the contact pivoting plate 77 that resists a little against the flow of the developer 51. When the contact pivoting plate 77 is remained in the first pattern, the height of the heap of the developer 51 during low humidity is α2. However, during low humidity, the contact pivoting plate 77 is pivoted to the second pattern to substantially eliminate the resistance against the flow of the developer 51. Therefore, even during low humidity, the height of the heap of the developer 51 is maintained at α1. When the contact pivoting plate 77 is remained in the first pattern, the height of the heap of the developer 51 during high humidity is α3. However, during high humidity, the contact pivoting plate 77 is pivoted to the third pattern to acquire large resistance against the flow of the developer 51. Therefore, even during high humidity, the height of the heap of the developer 51 is maintained at α1.

Since the contact pivoting plate 77 is pivoted according to the environmental change, the height of the heap of the developer 51 swelled by the discharge mixer 76 in the first agitation passage 71 is substantially constant regardless of the environmental change. The height of the heap of the developer 51 is maintained at about α1. Consequently, an amount of an excess developer discharged from the discharge port 53 is a substantially constant regardless of the environmental change. After passing through the discharge mixer 76, the developer 51 is circulated and carried to the second agitation passage 72 through the first conducting section 70*a* of the partition plate 70. In the second agitation passage 72, the developer 51 is agitated and carried by the second mixer 57 and supplied to the developing roller 58. Since the amount of the excess developer discharged from the discharge port 53 is stayed constant, the fluctuation in a developer amount in the case 50 is suppressed. Therefore, the supply of the developer to the developing roller 58 is stabilized. It is possible to maintain development performance and obtain a high image quality.

Environment life tests were conducted with the developing devices 14Y, 14M, 14C, and 14K according to the first embodiment mounted on the color printer 1. As test conditions, 400 g of the developer 51 is poured into the case 50 and an original of a photograph image with a printing ratio of 30% is used. In a constant temperature and constant humidity room in which an environmental condition could be changed, the environment is changed from (1) the ordinary temperature and ordinary humidity environment at the temperature of 20° C. and the humidity of 50% to (2) the high temperature and high humidity environment at the temperature of 30° C. and the humidity of 80%, (3) the low temperature and low humidity environment at the temperature of 10° C. and the humidity of 20%, and (4) the high temperature and high humidity environment at the temperature of 30° C. and the humidity of 80%. Under the environment conditions (1), (2), (3), and (4), the environment life tests were conducted for 2500 sheets for each of the environment conditions, i.e., 10000 sheets in total.

As a result, as shown in Table 1 of FIG. 9, in the first embodiment, unevenness of toner density and reduction of toner density of images do not occur and satisfactory image qualities are obtained in all the environmental conditions. The developer does not spill from an exposed portion of the developing roller 58 in all the environmental conditions. The weight of the developer 51 in the case 50 at a time when the tests are finished is about 410 g at a time when printing on predetermined 2500 sheets is finished in the ordinary temperature and ordinary humidity environment of (1), about 430 g (a rate of increase is about +8%) at a time when printing on predetermined 2500 sheets is finished in the high temperature and high humidity environment of (2), about 390 g (a rate of increase is about −3%) at a time when printing on predetermined 2500 sheets is finished in the low temperature and low humidity environment of (3), and about 430 g (a rate of increase is about +8%) at a time when printing on predetermined 2500 sheets is finished in the high temperature and high humidity environment of (4). In FIG. 9, the number of sheets is indicated in a summed up number. The summed number is 2500 at the time when the printing in the environment (1) is finished, 5000 at the time when the printing in the environment (2) is finished, 7500 at the time when the printing in the environment (3) is finished, and 10000 at the time when the printing in the environment (4) is finished.

At the time when the printing of 2500 sheets is finished in each of the environments, a roof portion of the case 50 is removed to observe a state of the developer 51. Under all the environmental conditions, parts of the vanes of the first mixer 56 and the second mixer 57, specifically, tips thereof are exposed from the developer 51 and no specific problem is found.

Figure 10:
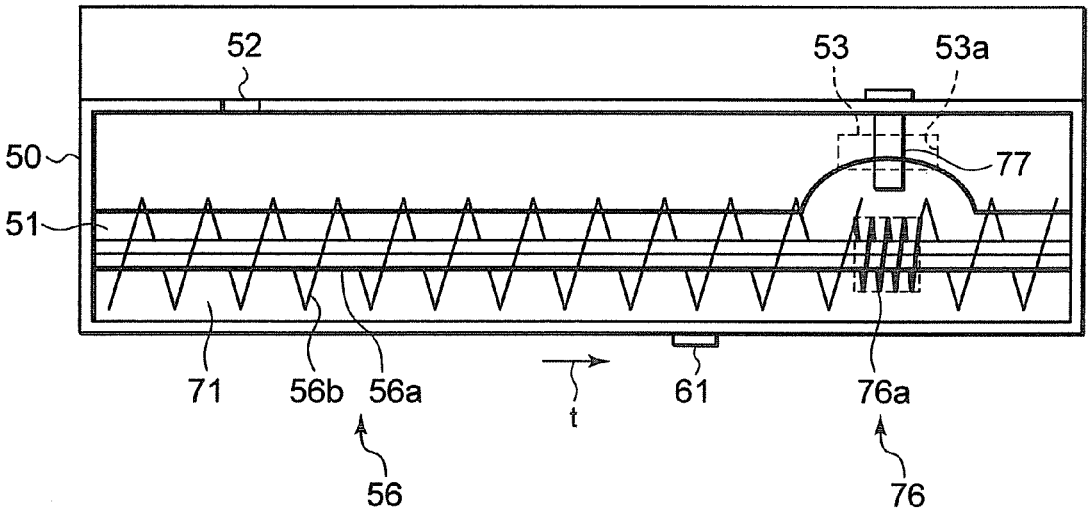
FIG. 10 is a schematic diagram for explaining an arrangement of a contact pivoting plate according to the comparative example 1.

On the other hand, in a comparative example 1 shown in FIG. 10, environment life tests for 10000 sheets in total is conducted under the same conditions as in the case of the first embodiment. The contact pivoting plate 77 is arranged further downstream than the discharge port 53 in the arrow "t" direction in the first embodiment. The contact pivoting plate 77 is arranged in a position opposed to the discharge port 53 in the comparative example 1. As test results, as shown in Table 1 of FIG. 9, in the comparative example 1, unevenness of toner density and reduction of toner density of images do not occur and satisfactory image qualities are obtained in the ordinary temperature and ordinary humidity environment. On the other hand, in the comparative example 1, reduction of toner density is observed in the low temperature and low humidity environment and unevenness of toner density is observed in the high temperature and high humidity environment. In the comparative example 1, the developer does not spill from the exposed portion of the developing roller 58 under all the environmental conditions.

In the comparative example 1, the weight of the developer 51 in the case 50 at the time when the tests are finished is about 410 g at a time when printing on predetermined 2500 sheets is finished in the ordinary temperature and ordinary humidity environment of (1), about 470 g (a rate of increase is about +17%) at a time when printing on predetermined 2500 sheets is finished in the high temperature and high humidity environment of (2), about 345 g (a rate of increase is about −14%) at a time when printing on predetermined 2500 sheets is finished in the low temperature and low humidity environment of (3), and about 470 g (a rate of increase is about +17%) at a time when printing on predetermined 2500 sheets is finished in the high temperature and high humidity environment of (4). In FIG. 9, the number of sheets is indicated in a summed up number. The summed up number is 2500 at the time when the printing in the environment (1) is finished, 5000 at the time when the printing in the environment (2) is finished, 7500 at the time when the printing in the environment (3) is finished, and 10000 at the time when the printing in the environment (4) is finished.

In the comparative example 1, at the time when the printing of 2500 sheets is finished in each of the environments, the roof portion of the case 50 is removed to observe a state of the developer 51. In the ordinary temperature and ordinary humidity environment, the tips of the vanes of the first mixer 56 and the second mixer 57 are exposed from the developer 51 and no specific problem is found. In the high temperature and high humidity environment, the developer does not spill from the exposed portion of the developing roller 58 but some portions of the case 50 are clogged with the developer 51. The first mixer 56 and the second mixer 57 are buried under the developer 51 in an unseen state. The agitation by the first mixer 56 and the second mixer 57 do not seem to be smoothly performed. In the low temperature and low humidity environment, the shaft portions of the first mixer 56 and the second mixer 57 are buried under the developer 51 but most of the vanes are exposed.

Figure 11:
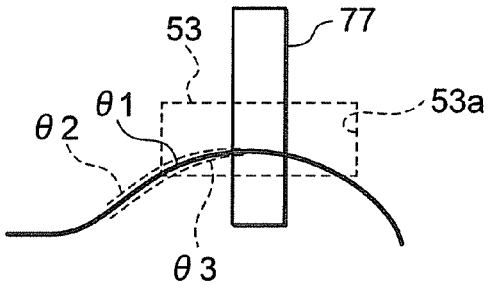
FIG. 11 is a schematic diagram for explaining a change in the swell of a developer due to an environmental change in the comparative example 1.

In the comparative example 1, a state of the swell of the developer 51 in the case 50 due to the environmental change is as shown in FIG. 11. The height of the heap of the developer 51 swelled by the discharge mixer 76 during ordinary temperature and ordinary humidity is represented by a solid line θ1. As the relative humidity falls, the swell of the developer 51 changed to a dotted line θ2. As the relative humidity rises, the swell of the developer 51 changed to a dotted line θ3. In the comparative example 1, the fluctuation in the swell of the developer 51 increased on the upstream side of the discharge port 53 because of the environmental change. Further, in the comparative example 1, it is seen that an excess developer to be discharged is disturbed by the contact pivoting plate 77 in the position opposed to the discharge port 53 and stable discharge could not be performed.

According to the first embodiment, the contact pivoting plate 77 is pivoted according to a detection result of the temperature and humidity sensor 15 to change the magnitude of the resistance of the contact pivoting plate 77 against the flow of the developer 51. Consequently, regardless of the environmental change, it is possible to maintain the height of the heap of the developer 51, which is held up and swelled by the discharge mixer 76, substantially the same as the height during ordinary temperature and ordinary humidity. In other words, it is possible to maintain an amount of the excess developer, which is discharged from the discharge port 53 in order to replace the deteriorated carrier with the new carrier, at a substantially constant. Therefore, the fluctuation in a developer amount in the case 50 is suppressed and a high image quality is obtained by maintaining development performance. Moreover, in the first embodiment, the contact pivoting plate 77 is arranged further on the downstream side than the discharge port 53. Therefore, the excess developer discharged from the discharge port 53 is not disturbed by the contact pivoting plate 77. It is possible to stably discharge the excess developer from the discharge port 53. In the first embodiment, a movable member is not provided around the discharge port 53. Therefore, it is unlikely that the developer 51 in the case 50 leaks from the gap of the discharge port 53.

A second embodiment of the present invention is explained below. The second embodiment is different from the first embodiment in the structure of the adjusting member. Otherwise, the second embodiment is the same as the first embodiment. Therefore, components same as those explained in the first embodiment are denoted by the same reference numerals and signs and detailed explanation of the components is omitted.

Figure 12:
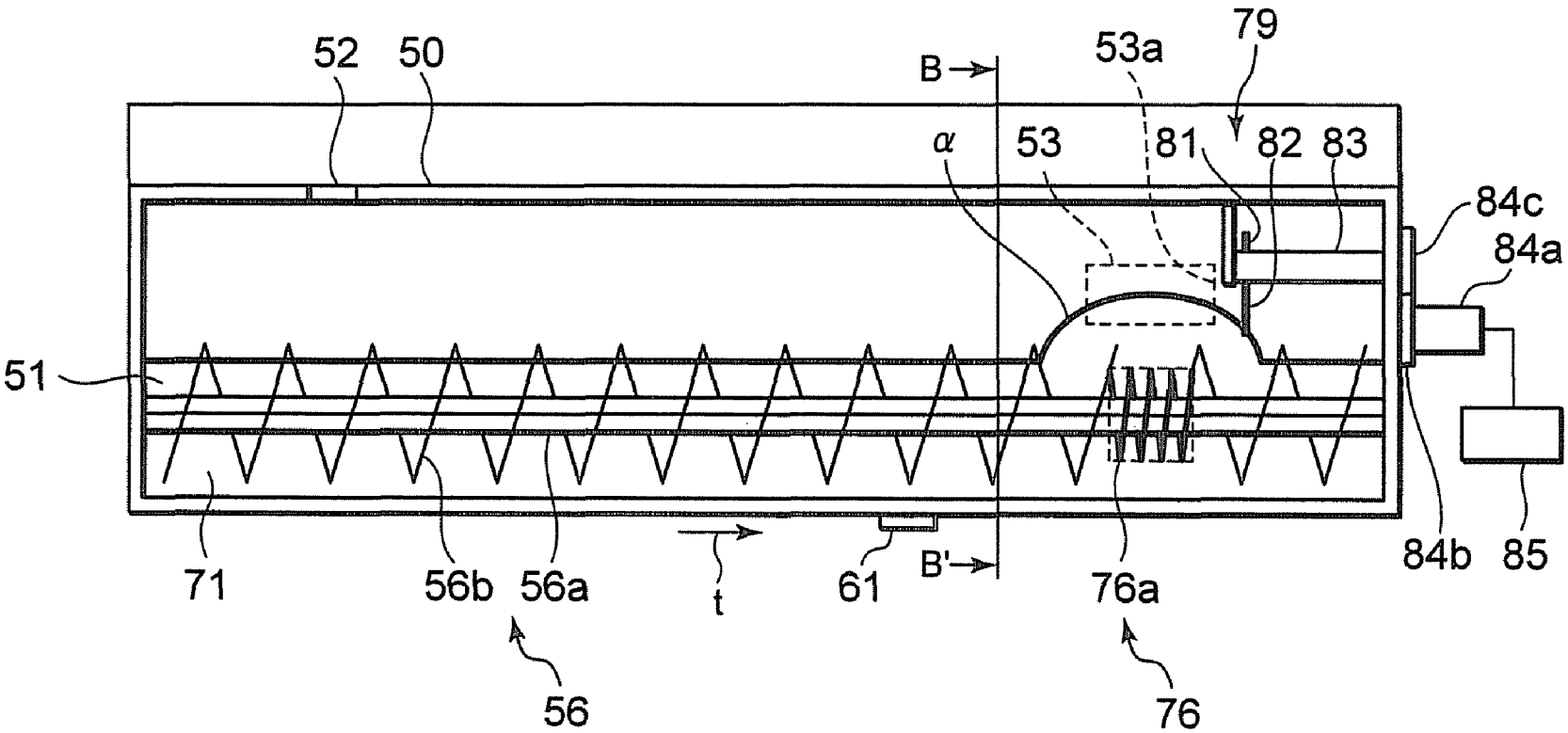
FIG. 12 is a schematic diagram for explaining the swell of a developer in a development container according to a second embodiment of the present invention.
Figure 13:
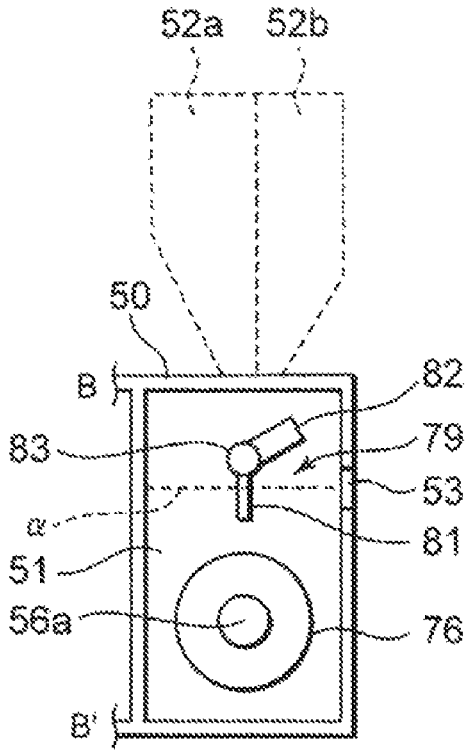
FIG. 13 is a schematic diagram for explaining contact vanes viewed from a B-B' side in FIG. 12 according to the second embodiment.

In this embodiment, as shown in FIGS. 12 and 13, a contact pivoting plate 79 as an adjusting member is provided in the case 50. The contact pivoting plate 79 has a first contact vane 81 and a second contact vane 82. An interior angle of the first contact vane 81 and the second contact vane 82 is 120 degrees. However the interior angle is not limited to 120 degrees. The width of the second contact vane 82 is wider than the width of the first contact vane 81 in a direction orthogonal to a flow of the developer 51 in the arrow "t" direction. The first contact vane 81 and the second contact vane 82 are supported by a support shaft 83 that is provided above the shaft 56*a* of the first mixer 56 and pivots. Like the contact pivoting plate 77 according to the first embodiment, the first contact vane 81, the second contact vane 82, and the support shaft 83 are formed of a thin plate made of ABS resin.

The first contact vane 81 and the second contact vane 82 are arranged further downstream than the side end 53*a* on the downstream side of the discharge port 53 in the arrow "t" direction. This makes it unlikely that the discharge of the excess developer discharged from the discharge port 53 is prevented by the first contact vane 81 and the second contact vane 82. The first contact vane 81 or the second contact vane 82 comes into contact with the surface of the developer 51 according to the pivoting of the support shaft 83. The first contact vane 81 or the second contact vane 82 acquire resistance against the flow of the developer 51 in the arrow "t" direction by coming into contact with the surface of the developer 51.

The support shaft 83 is attached to a fourth gear 84*c* coupled to a third gear 84*b* of a second stepping motor 84*a*. The second stepping motor 84*a* is driven by a second motor control unit 85 according to a detection result of the temperature and humidity sensor 15. When the second stepping motor 84*a* is driven, the support shaft 83 and the first and second contact vanes 81 and 82 are pivoted.

Figure 14:
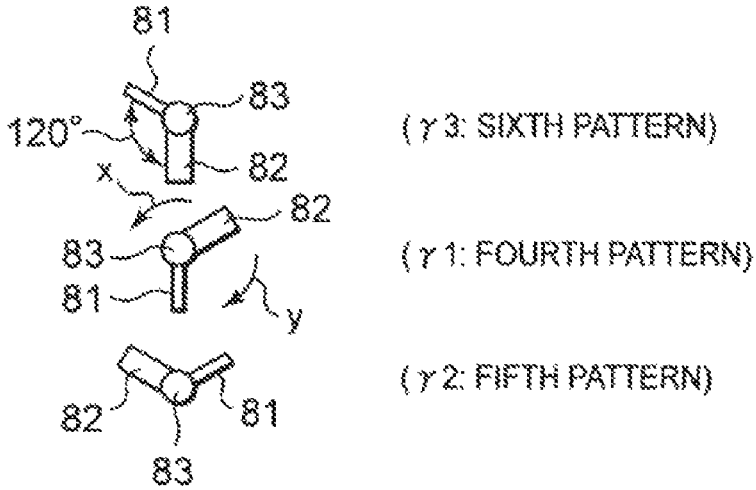
FIG. 14 is a schematic diagram for explaining patterns of the contact vanes to be set according to an environmental change according to the second embodiment.

An arrangement of the first contact vane 81 or the second contact vane 82 with respect to the developer 51 by the rotation of the support shaft 83 is shown in FIG. 14. When an environmental condition detected by the temperature and humidity sensor 15 is "ordinary temperature and ordinary humidity" at the temperature of 20° C. and the humidity of 50%, the first contact vane 81 and the second contact vane 82 are arranged in a fourth pattern indicated by γ1. In the fourth pattern, the first contact vane 81 comes into contact with the developer 51. Consequently, the flow of the developer 51 is subjected to slight resistance to change the height of the heap of the developer 51 to the solid line α1 shown in FIG. 5 during ordinary humidity.

When the environmental condition is "low temperature and low humidity" at the temperature of 10° C. and the humidity of 20%, the second stepping motor 84*a* is driven by a predetermined step to pivot the support shaft 83 120° in an arrow "x" direction in FIG. 14 from a state of the fourth pattern. The first contact vane 81 and the second contact vane 82 are arranged in a fifth pattern indicated by γ2. In the fifth pattern, both the first contact vane 81 and the second contact vane 82 do not come into contact with the developer 51. Consequently, the flow of the developer 51 is not subjected to resistance at all. The height of the heap of the developer 51 is adjusted to maintain α1 even during low humidity.

When the environmental condition is "high temperature and high humidity" at the temperature of 30° C. and the humidity of 80%, the second stepping motor 84*a* is driven by a predetermined step to pivot the support shaft 83 120° in an arrow "y" direction in FIG. 14 from the state of the fourth pattern. The first contact vane 81 and the second contact vane 82 are arranged in a sixth pattern indicated by γ3. In the sixth pattern, the second contact vane 82 comes into contact with the developer 51. Consequently, the flow of the developer 51 is subjected to large resistance. The height of the heap of the developer 51 is adjusted to maintain α1 even during high humidity.

Since the support shaft 83 is pivoted according to the environmental change, the height of the heap of the developer 51 swelled by the discharge mixer 76 in the first agitation passage 71 is substantially constant regardless of the environmental change. The height of the heap of the developer 51 is maintained at substantially α1. Consequently, an amount of the excess developer discharged from the discharge port 53 is substantially constant regardless of the environmental change. The fluctuation in a developer amount in the case 50 is suppressed, the feeding of the developer to the developing roller 58 is stabilized, development performance can be maintained, and a high image quality can be obtained.

According to the second embodiment, same as in the first embodiment, the support shaft 83, the first contact vane 81, and the second contact vane 82 are pivoted according to a detection result of the temperature and humidity sensor 15 to change the magnitude of the resistance against the flow of the developer 51. Consequently, regardless of the environmental change, it is possible to maintain the height of the heap of the developer 51, which is held up and swelled by the discharge mixer 76, at height substantially the same as the height during ordinary temperature and ordinary humidity. Consequently, it is possible to maintain an amount of the excess developer, which is discharged from the discharge port 53, at a substantially constant. Therefore, the fluctuation in a developer amount in the case 50 is suppressed and a high image quality is obtained by maintaining development performance. Moreover, the excess developer discharged from the discharge port 53 is not disturbed by the support shaft 83, the first contact vane 81, and the second contact vane 82. It is possible to stably discharge the excess developer from the discharge port 53. Therefore, it is unlikely that the developer 51 in the case 50 leaks from the gap of the discharge port 53.

A third embodiment of the present invention is explained below. The third embodiment is different from the first embodiment in the structure of the adjusting member. Otherwise, the third embodiment is the same as the first embodiment. Therefore, components same as those explained in the first embodiment are denoted by the same reference numerals and signs and detailed explanation of the components is omitted.

In this embodiment, as shown in FIGS. 15 to 18, a contact slide plate 86 as an adjusting member is provided. The contact slide plate 86 is arranged further downstream than the side end 53*a* on the downstream side of the discharge port 53 in the arrow "t" direction. This makes it unlikely that the discharge of the excess developer discharged from the discharge port 53 is prevented by the contact slide plate 86. Like the contact pivoting plate 77 according to the first embodiment, the contact slide plate 86 is formed of a thin plate made of ABS resin. The contact slide plate 86 comes into contact with the surface of the developer 51 to acquire resistance against the flow of the developer 51 in the arrow "t" direction.

The contact slide plate 86 is attached to a support plate 87*d* having a rack 87*c* coupled to a fifth gear 87*b* of a third stepping motor 87*a*. The third stepping motor 87*a* is driven by a third motor control unit 89 according to a detection result of the temperature and humidity sensor 15. The support plate 87*d* is guided by a guide rail 88 to reciprocatingly move in a direction parallel to the flow of the developer 51.

Figure 15:
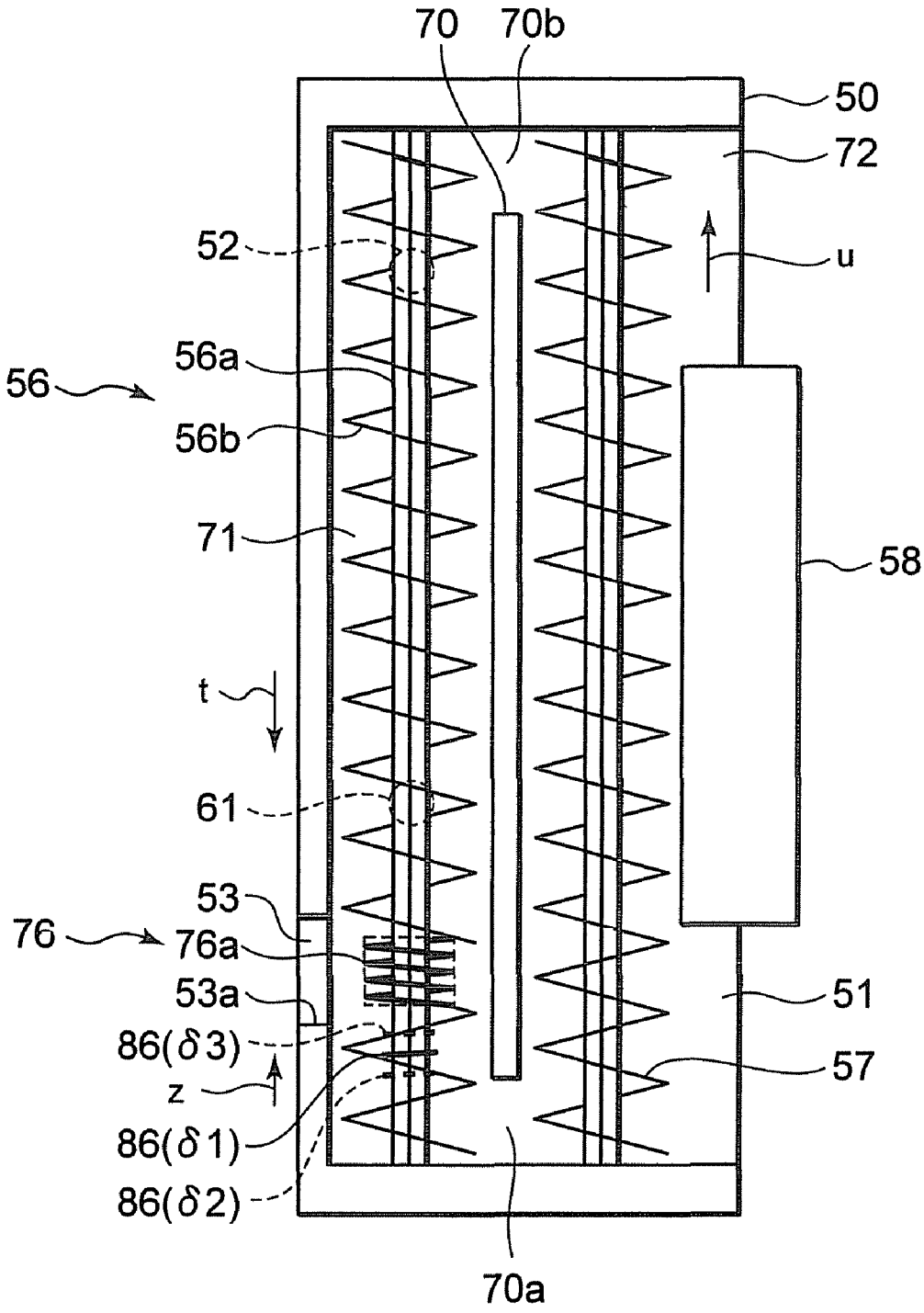
FIG. 15 is a schematic diagram for explaining a flow of a developer in a development container according to a third embodiment of the present invention.
Figure 16:
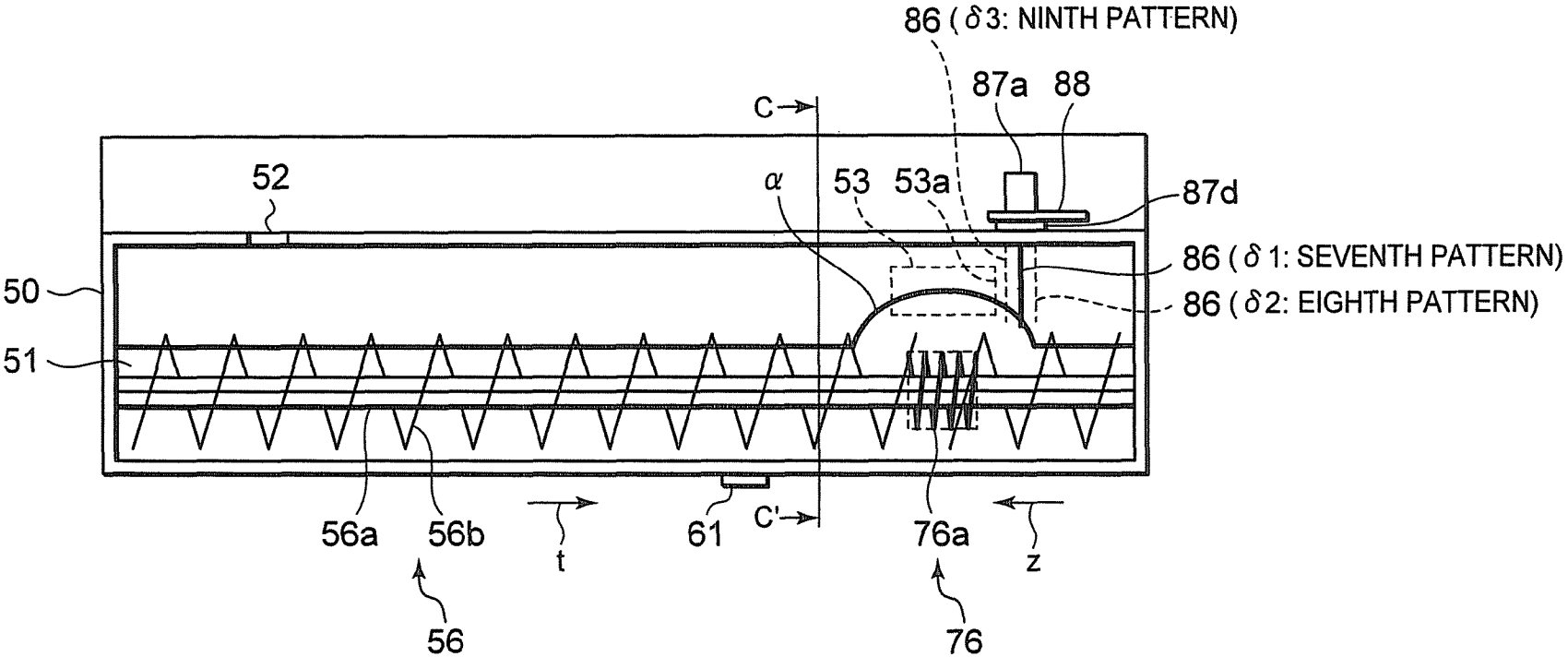
FIG. 16 is a schematic diagram for explaining patterns of a contact slide plate to be arranged according to an environmental change according to the third embodiment.
Figure 20:
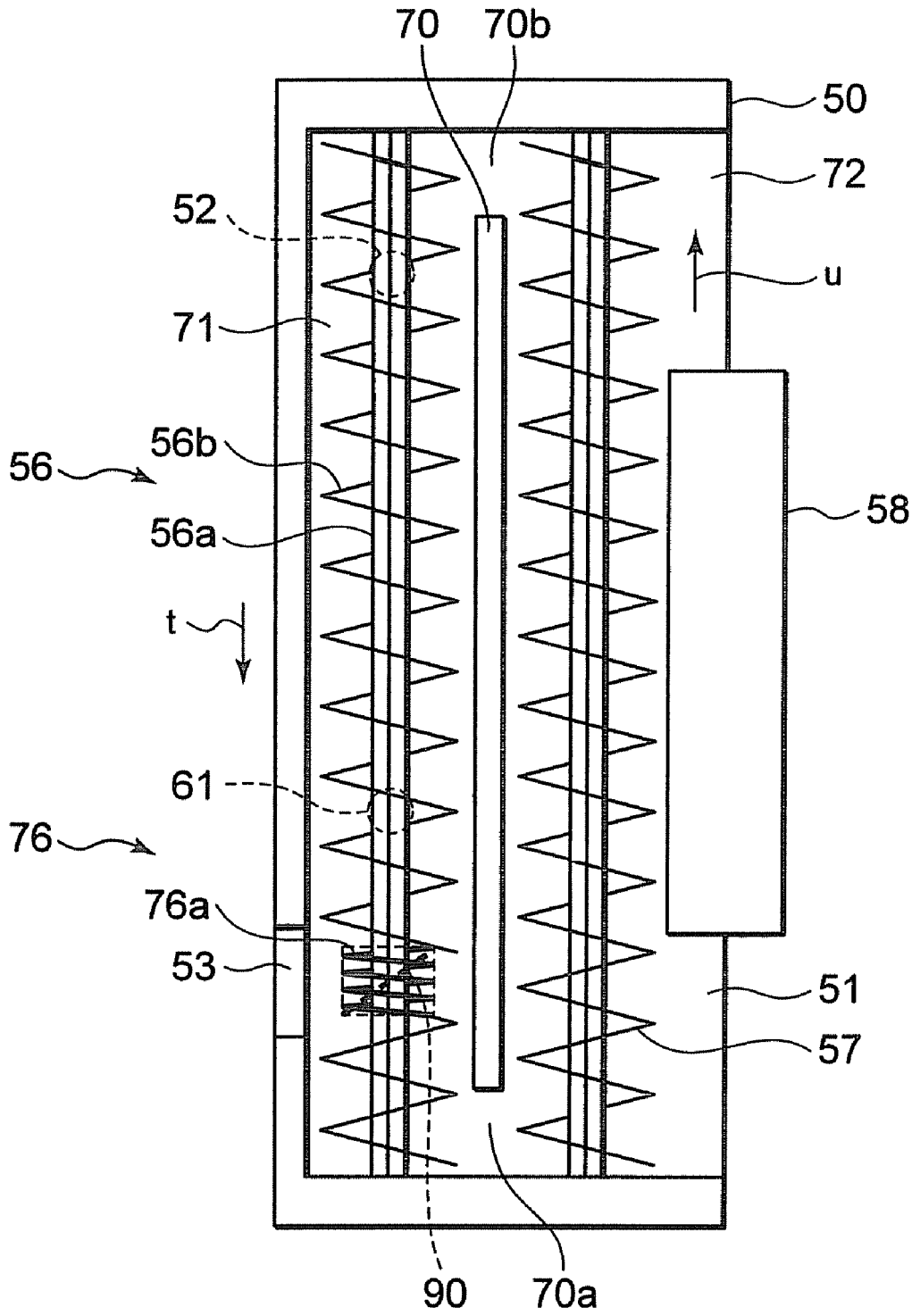
FIG. 20 is a schematic diagram for explaining a flow of a developer in a development container according to a fourth embodiment of the present invention.
Figure 21:
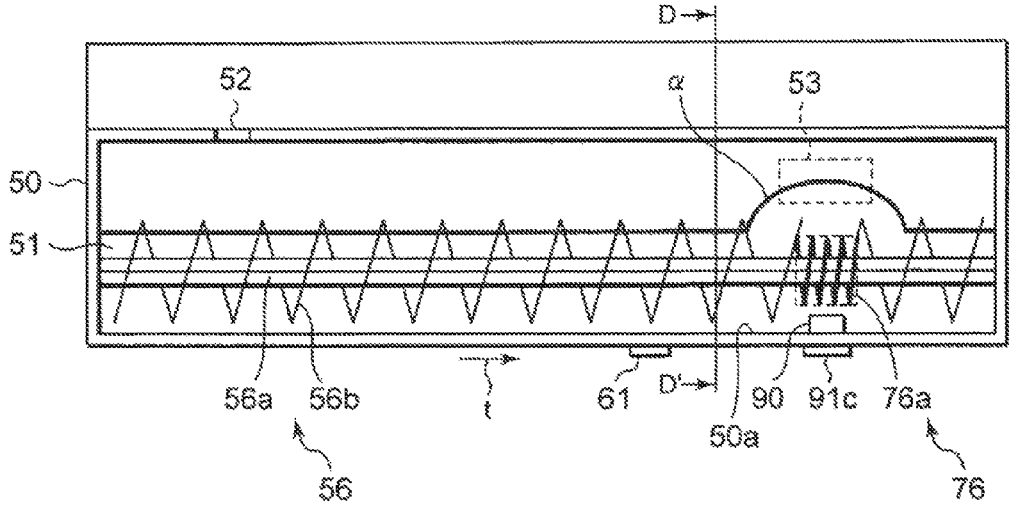
FIG. 21 is a schematic diagram for explaining the swell of the developer in the development container according to the fourth embodiment.
Figure 22:
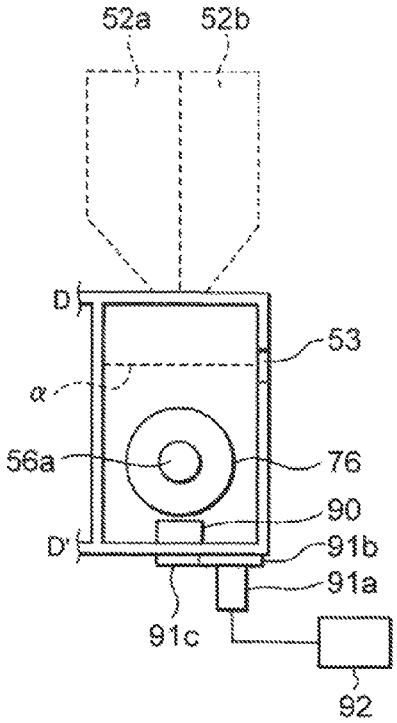
FIG. 22 is a schematic diagram of a driving unit for an inner pivoting plate viewed from a D-D' side in FIG. 21 according to the fourth embodiment.

An arrangement of the contact slide plate 86 in the case 50 is shown in FIGS. 15 and 16. When an environmental condition detected by the temperature and humidity sensor 15 is, for example, "ordinary temperature and ordinary humidity" at the temperature of 20° C. and the humidity of 50%, the contact slide plate 86 is arranged in a seventh pattern indicated by δ1. In the seventh pattern, the contact slide plate 86 comes into slight contact with the heap of the developer 51. Consequently, the flow of the developer 51 is subjected to slight resistance to change the height of the heap of the developer 51 to the solid line α1 shown in FIG. 5 during ordinary temperature.

When the environmental condition is "low temperature and low humidity" at the temperature of 10° C. and the humidity of 20%, the third stepping motor 87*a* is driven by a predetermined step to pivot the fifth gear 87*b* in an arrow "n" direction. The rack 87*c* coupled to the fifth gear 87*b* slides in the arrow "t" direction while being guided by the guide rail 88. Consequently, the contact slide plate 86 slightly slides in the arrow "t" direction from a state of the seventh pattern. The contact slide plate 86 is arranged in an eighth pattern indicated by δ2. In the eighth pattern, the contact slide plate 86 does not come into contact with the developer 51. Consequently, the flow of the developer 51 is not subjected to resistance at all. The height of the heap of the developer 51 is adjusted to maintain α1 even during low humidity.

When the environmental condition is "high temperature and high humidity" at the temperature of 30° C. and the humidity of 80%, the third stepping motor 87*a* is driven by a predetermined step from the state of the seventh pattern to pivot the fifth gear 87*b* by a predetermined amount in a direction opposite to the arrow "n" direction. The rack 87*c* coupled to the fifth gear 87*b* slides in an arrow "z" direction while being guided by the guide rail 88. Consequently, the contact slide plate 86 slightly slides in the arrow "z" direction. The contact slide plate 86 is arranged in a ninth pattern indicated by δ3. In the ninth pattern, the contact slide plate 86 comes into contact with the heap of the developer 51 in a large area. Consequently, the flow of the developer 51 is subjected to large resistance. The height of the heap of the developer 51 is adjusted to maintain α1 even during high humidity.

Since the contact slide plate 86 is slid according to the environmental change, the height of the heap of the developer 51 swelled by the discharge mixer 76 in the first agitation passage 71 is substantially constant regardless of the environmental change. The height of the heap of the developer 51 is maintained at substantially α1. Consequently, an amount of the excess developer discharged from the discharge port 53 is a substantially constant regardless of the environmental change. The fluctuation in a developer amount in the case 50 is suppressed, the feeding of the developer to the developing roller 58 is stabilized, development performance can be maintained, and a high image quality can be obtained.

According to the third embodiment, same as in the first embodiment, the contact slide plate 86 is slid according to a detection result of the temperature and humidity sensor 15 to change the magnitude of the resistance against the flow of the developer 51. Consequently, regardless of the environmental change, it is possible to maintain the height of the heap of the developer 51, which is held up and swelled by the discharge mixer 76, at height substantially the same as the height during ordinary temperature and ordinary humidity. Consequently, it is possible to maintain an amount of the excess developer, which is discharged from the discharge port 53, at a substantially constant. Therefore, the fluctuation in a developer amount in the case 50 is suppressed and a high image quality is obtained by maintaining development performance. Moreover, the excess developer discharged from the discharge port 53 is not disturbed by the contact slide plate 86. It is possible to stably discharge the excess developer from the discharge port 53. Therefore, it is unlikely that the developer 51 in the case 50 leaks from the gap of the discharge port 53.

Environment life tests were conducted in the first to third embodiments with the developing devices 14Y, 14M, 14C, and 14K according to the embodiments mounted on the color printer 1. As test conditions, 400 g of the developer 51 is poured into the case 50 and an original of a photograph image with a printing ratio of 30% is used.

In a constant temperature and constant humidity room in which an environmental condition could be changed, the environment is changed from (1) the ordinary temperature and ordinary humidity environment at the temperature of 20° C. and the humidity of 50% to (2) the high temperature and high humidity environment at the temperature of 30° C. and the humidity of 80%, (3) the low temperature and low humidity environment at the temperature of 10° C. and the humidity of 20%, and (4) the high temperature and high humidity environment at the temperature of 30° C. and the humidity of 80%.

Under the environment conditions (1), (2), (3), and (4), the environment life tests were conducted for 2500 sheets for each of the environment conditions, i.e., 10000 sheets in total.

As a result, as shown in Table 2 of FIG. 19, in the first to third embodiments, unevenness of toner density of images do not occur and satisfactory image qualities are obtained in all the environmental conditions. The developer does not spill from the exposed portion of the developing roller 58 in all the environmental conditions. The weight of the developer 51 in the case 50 is about 410 g at a time when printing on predetermined 2500 sheets is finished in the ordinary temperature and ordinary humidity environment of (1), about 430 g (a rate of increase is about +8%) at a time when printing on predetermined 2500 sheets is finished in the high temperature and high humidity environment of (2), about 390 g (a rate of increase is about −3%) at a time when printing on predetermined 2500 sheets is finished in the low temperature and low humidity environment of (3), and about 430 g (a rate of increase is about +8%) at a time when printing on predetermined 2500 sheets is finished in the high temperature and high humidity environment of (4). In FIG. 19, the number of sheets is indicated in a summed up number. The summed up number is 2500 at the time when the printing in the environment (1) is finished, 5000 at the time when the printing in the environment (2) is finished, 7500 at the time when the printing in the environment (3) is finished, and 10000 at the time when the printing in the environment (4) is finished.

In the first to third embodiments, at the time when the printing on 2500 sheets is finished in each of the environments, the roof portion of the case 50 is removed to observe a state of the developer 51. Under all the environmental conditions, the tips of the vanes of the first mixer 56 and the second mixer 57 are exposed from the developer 51 and no specific problem is found.

On the other hand, in a comparative example 2, environment life tests for 10000 sheets in total were conducted under the same conditions as in the case of the first to third embodiments with developing devices not including adjusting members mounted on the printer 1. As test results, as shown in Table 2 of FIG. 19, in the comparative example 2, unevenness of toner density of images do not occur and satisfactory image qualities are obtained in the ordinary temperature and ordinary humidity environment. However, in the high temperature and high humidity environment following the ordinary temperature and ordinary humidity environment, unevenness of toner density of images and a spill of the developer from the exposed portion of the developing roller 58 are observed. In the low temperature and low humidity environment, although there is no spill of the developer, traces of the vanes of the second mixer 57 due to a reduction of toner density is observed in images.

In the comparative example 2, the weight of the developer 51 in the case 50 is about 410 g at a time when printing on predetermined 2500 sheets is finished in the ordinary temperature and ordinary humidity environment of (1), about 530 g (a rate of increase is about +30%) at a time when printing on predetermined 2500 sheets is finished in the high temperature and high humidity environment of (2), about 320 g (a rate of increase is about −20%) at a time when printing on predetermined 2500 sheets is finished in the low temperature and low humidity environment of (3), and about 530 g (a rate of increase is about +30%) at a time when printing on predetermined 2500 sheets is finished in the high temperature and high humidity environment of (4).

In the comparative example 2, at the time when printing on the printing on 2500 sheets is finished in each of the environments, the roof portion of the case 50 is removed to observe a state of the developer 51. In the ordinary temperature and ordinary humidity environment, the tips of the vanes of the first mixer 56 and the second mixer 57 are exposed from the developer 51 and no specific problem is found. In the high temperature and high humidity environment, the first mixer 56 and the second mixer 57 are buried in a completely unseen state and are partially squeezed. The agitation by the first mixer 56 and the second mixer 57 do not seem to be smoothly performed. In the low temperature and low humidity environment, the first mixer 56 and the second mixer 57 are seen up to the shaft portions thereof. An amount of the developer 51 is extremely small. The agitation does not seem to be smoothly performed.

A fourth embodiment of the present invention is explained below. The fourth embodiment is different from the first embodiment in the structure of the adjusting member. Otherwise, the fourth embodiment is the same as the first embodiment. Therefore, components same as those explained in the first embodiment are denoted by the same reference numerals and signs and detailed explanation of the components is omitted.

In this embodiment, as shown in FIGS. 20 to 23, an inner pivoting plate 90 as an adjusting member is provided. The inner pivoting plate 90 is arranged in a space between the discharge mixer 76 and a bottom surface 50*a* of the case 50. The center of the inner pivoting plate 90 is located in the center of the discharge mixer 76 in the arrow "t" direction in this embodiment. However, an arrangement position of the inner pivoting plate 90 is not limited as long as the inner pivoting plate 90 is arranged in an area of the discharge mixer 76 in the arrow "t" direction. Like the contact pivoting plate 77 according to the first embodiment, the inner pivoting plate 90 is formed of a thin plate made of ABS resin. The inner pivoting member 90 has resistance against the flow of the developer 51 in the arrow "t" direction.

The inner pivoting plate 90 is attached to an eighth gear 91*c* coupled to a seventh gear 91*b* of a fourth stepping motor 91*a*. The fourth stepping motor 91*a* is driven by a fourth motor control unit 92 according to a detection result of the temperature and humidity sensor 15.

Figure 23:
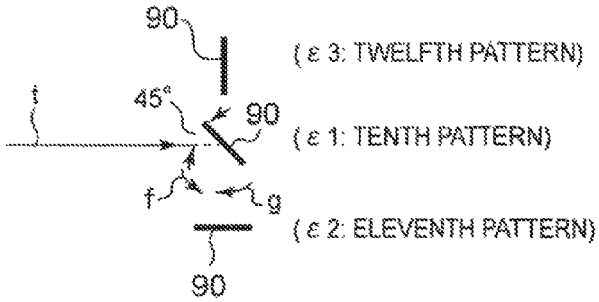
FIG. 23 is a schematic diagram for explaining patterns of the inner pivoting plate to be set according to an environmental change according to the fourth embodiment.

An angle of the inner pivoting plate 90 with respect to the flow of the developer 51 in the arrow "t" direction is shown in FIG. 23. When an environmental condition detected by the temperature and humidity sensor 15 is, for example, "ordinary temperature and ordinary humidity" at the temperature of 20° C. and the humidity of 50%, the inner pivoting plate 90 is arranged in a tenth pattern indicated by $\epsilon$1. The inner pivoting plate 90 is set at 45° with respect to the arrow "t" direction. In the tenth pattern, the flow of the developer 51 is subjected to slight resistance. Consequently, the height of the heap on the surface of the developer 51 is as indicated by the solid line $\alpha$1 in FIG. 5 during ordinary humidity.

When the environmental condition is "low temperature and low humidity" at the temperature of 10° C. and the humidity of 20%, the fourth stepping motor 90*a* is driven by a predetermined step. The inner pivoting plate 90 pivots 45° in an arrow "f" direction from a state of the tenth pattern. Consequently, the inner pivoting plate 90 is arranged in an eleventh pattern indicated by $\epsilon$2. In the eleventh pattern, the inner pivoting plate 90 is parallel to the arrow "t" direction. Consequently, the flow of the developer 51 is subjected to almost no resistance. The height of the heap on the surface of the developer is adjusted to maintain $\alpha$1 even during low humidity.

When the environmental condition is "high temperature and high humidity" at the temperature of 30° C. and the humidity of 80%, the fourth stepping motor 90*a* is driven by a predetermined step from the state of the tenth pattern. The inner pivoting plate 90 pivots 45° in an arrow "g" direction. Consequently, the inner pivoting plate 90 is arranged in a twelfth pattern indicated by $\epsilon$3. In the twelfth pattern, the inner pivoting plate 90 is perpendicular to the arrow "t" direction. Consequently, the flow of the developer 51 is subjected to large resistance. The height of the heap on the surface of the developer 51 is adjusted to maintain $\alpha$1 even during high humidity.

Since the inner pivoting plate 90 is pivoted according to the environmental change, the height of the heap of the developer 51 swelled by the discharge mixer 76 in the first agitation passage 71 is substantially constant regardless of the environmental change. The height of the heap of the developer 51 is maintained at substantially $\alpha$1. Consequently, an amount of the excess developer discharged from the discharge port 53 is a substantially constant regardless of the environmental change. The fluctuation in a developer amount in the case 50 is suppressed, the feeding of the developer to the developing roller 58 is stabilized, development performance can be maintained, and a high image quality can be obtained.

According to the fourth embodiment, same as in the first embodiment, the inner pivoting plate 90 is slid according to a detection result of the temperature and humidity sensor 15 to change the magnitude of the resistance against the flow of the developer 51. Consequently, regardless of the environmental change, it is possible to maintain the height of the heap of the developer 51, which is held up and swelled by the discharge mixer 76, at height substantially the same as the height during ordinary temperature and the ordinary humidity. Consequently, it is possible to maintain an amount of the excess developer, which is discharged from the discharge port 53, at a substantially constant. Therefore, the fluctuation in a developer amount in the case 50 is suppressed and a high image quality is obtained by maintaining development performance. Moreover, it is unlikely that the developer 51 in the case 50 leaks from the gap of the discharge port 53. The inner pivoting plate 90 is arranged by using the space between the discharge mixer 76 and the bottom surface 50*a* of the case 50. Therefore, the inner pivoting plate 90 does no prevent the rotation of the first mixer 56 and the discharge mixer 76. Since the inner pivoting plate 90 is arranged in the developer 51, for example, even if a main body of the color printer 1 tilts, it is unlikely that resistance to the developer 51 is fluctuated.

The present invention is not limited to the embodiments explained above. Various modifications of the embodiments are possible without departing from the spirit of the present invention. For example, methods of supplying a toner and a carrier and supply amounts of the toner and the carrier are not limited. The position and the size of the developer discharging unit and the height of the surface of a developer swelled by the swelling member are not limited. Moreover, the material and the structure of the adjusting member, a method of adjusting the adjusting member, and an amount of adjustment of the adjusting member are not limited. For example, setting of an environmental condition is arbitrary according to a type and an amount of a developer. The material of the adjusting member only has to be a material that does not hinder charging performance of the developer. A DC motor may be used for driving the adjusting member. When the DC motor is used, a photo sensor may be used to detect a driving amount of the adjusting member or an encoder may be used to detect a driving amount of the adjusting member.

What is claimed is:

1. A developing device comprising:

a development container that stores a developer including a toner and a carrier and discharges a part of the developer from a discharging member;

a developing member that feeds the developer in the development container to an image bearing member;

a developer supplying member that supplies the developer to the development container;

an agitating and carrying member that agitates the developer and circulates and carries the developer in the development container;

a swelling member that swells a surface of the developer, which is opposed to the discharging member; and an adjusting member that adjusts height of the developer, which is swelled by the swelling member, according to a detection result of an environment detecting member.

2. The device according to claim 1, wherein the adjusting member is located further downstream than the discharging member in a circulating and carrying direction of the developer and comes into contact with the surface of the developer swelled by the swelling member.

3. The device according to claim 2, wherein the adjusting member is a contact slide plate that slides in parallel to the circulating and carrying direction and adjusts the height of the developer.

4. The device according to claim 2, wherein the adjusting member is a contact pivoting plate that changes an angle with respect to the circulating and carrying direction and adjusts the height of the developer.

5. The device according to claim 2, wherein the adjusting member is a contact vane that includes plural vanes having different widths and alternates a vane coming into contact with the surface of the developer to adjust height of the developer.

6. The device according to claim 1, wherein the agitating and carrying member has an agitating and carrying vane around a shaft, the swelling member has a swelling vane member, which has an outer diameter smaller than that of the agitating and carrying vane, around the shaft, and the adjusting member is arranged in the developer in a position face to the swelling member.

7. The device according to claim 6, wherein the adjusting member is an inner pivoting plate that changes the angle with respect to the circulating and carrying direction to adjust the height of the developer.

8. The device according to claim 1, wherein the adjusting member is arranged in the development container.

9. The device according to claim 1, wherein size of the discharging member is fixed.

10. An image forming apparatus comprising:

an image bearing member;

a latent image forming member that forms an electrostatic latent image on the image bearing member;

a development container that stores a developer including a toner and a carrier and discharges a part of the developer from a discharging member;

a developing member that feeds the developer in the development container to the image bearing member;

a developer supplying member that supplies the developer to the development container;

an agitating and carrying member that agitates the developer and circulates and carries the developer in the development container;

a swelling member that swells a surface of the developer, which is opposed to the discharging member; and an adjusting member that adjusts height of the developer, which is swelled by the swelling member, according to a detection result of an environment detecting member.

11. The apparatus according to claim 10, wherein the adjusting member is located further downstream than the discharging member in a circulating and carrying direction of the developer and comes into contact with the surface of the developer swelled by the swelling member.

12. The apparatus according to claim 11, wherein the adjusting member is a contact slide plate that slides in parallel to the circulating and carrying direction and adjusts the height of the developer.

13. The apparatus according to claim 11, wherein the adjusting member is a contact pivoting plate that changes an angle with respect to the circulating and carrying direction and adjusts the height of the developer.

14. The apparatus according to claim 11, wherein the adjusting member is a contact vane that includes plural vanes having different widths and alternates a vane coming into contact with the surface of the developer to adjust height of the developer.

15. The apparatus according to claim 10, wherein the agitating and carrying member has an agitating and carrying vane around a shaft, the swelling member has a swelling vane member, which has an outer diameter smaller than that of the agitating and carrying vane, around the shaft, and the adjusting member is arranged in the developer in a position face to the swelling member.

16. The apparatus according to claim 15, wherein the adjusting member is an inner pivoting plate that changes the angle with respect to the circulating and carrying direction to adjust the height of the developer.

17. The apparatus according to claim 10, wherein the adjusting member is arranged in the development container.

18. The apparatus according to claim 10, wherein size of the discharging member is fixed.

19. A developing method comprising:

feeding a developer including a toner and a carrier, which is circulated and carried in a development container, to an image bearing member;

supplying the developer to the development container;

swelling a surface of the developer, which is opposed to a discharging member formed in the development container;

adjusting height of the developer, which is swelled, according to an environment; and discharging a part of the developer from the discharging member.

20. The method according to claim 19, wherein the adjustment of the height of the developer is performing by contacting the adjusting member with a surface of the developer on a downstream side than the discharging member in a circulating and carrying direction of the developer.

21. The method according to claim 20, wherein the adjustment of the height of the developer is performed by sliding the adjusting member in parallel to the circulating and carrying direction.

22. The method according to claim 20, wherein the adjustment of the height of the developer is performed by changing an angle of the adjusting member with respect to the circulating and carrying direction.

23. The method according to claim 20, wherein the adjustment of the height of the developer is performed by changing a width of contact of the adjusting member with the developer.

24. The method according to claim 19, wherein the adjustment of the height of the developer is performed by changing an angle of an inner adjusting member with respect to a circulating and carrying direction in the developer.

* * * * *